US008196530B1

(12) United States Patent
Van Dyk et al.

(10) Patent No.: US 8,196,530 B1
(45) Date of Patent: Jun. 12, 2012

(54) CHRISTMAS TREE SUPPORTING TABLE

(76) Inventors: Elizabeth Van Dyk, Little Rock, AR (US); Andre Van Dyk, Little Rock, AR (US)

( * ) Notice: Subject to any disclaimer, the term of this patent is extended or adjusted under 35 U.S.C. 154(b) by 482 days.

(21) Appl. No.: 12/487,088

(22) Filed: Jun. 18, 2009

(51) Int. Cl.
*A47B 91/00* (2006.01)

(52) U.S. Cl. ..... 108/191; 108/166; 108/159; 312/262

(58) Field of Classification Search ..... 312/258, 312/262; 248/519, 529; 108/50.12, 91, 191, 108/157.15, 157.17, 166–167, 171, 159, 108/150
See application file for complete search history.

(56) References Cited

U.S. PATENT DOCUMENTS

| | | | | |
|---|---|---|---|---|
| 1,943,659 | A | 1/1934 | Eason | |
| 2,639,114 | A * | 5/1953 | Allen | 248/167 |
| 2,874,496 | A | 2/1959 | Rakes | |
| 5,131,618 | A | 7/1992 | Chapin | |
| D356,522 | S | 3/1995 | Schroeder | |
| D381,930 | S | 8/1997 | Faller | |
| 5,732,926 | A | 3/1998 | Baumgartner | |
| 5,911,633 | A | 6/1999 | Sofy et al. | |
| 6,155,529 | A | 12/2000 | De Carlo | |
| 2004/0195487 | A1 * | 10/2004 | Harbaugh | 248/519 |
| 2006/0169865 | A1 | 8/2006 | Solak | |

* cited by examiner

*Primary Examiner* — Hanh V Tran
(74) *Attorney, Agent, or Firm* — Kyle Fletcher

(57) ABSTRACT

The Christmas tree supporting table includes a box support, a circular tabletop that has a hole about the middle and is divided into two sections that are hingedly connected. The box support contains the Christmas tree stand and a power strip for powering the Christmas tree lights. The circular tabletop folds flat upon the box and the Christmas tree stand and base of the Christmas tree. The supporting table elevates the Christmas tree, hides the Christmas tree stand, and provides a hiding place for a power strip to supply electricity to the Christmas tree lights.

15 Claims, 5 Drawing Sheets

14
13

12
10
11
11B
12A

CHRISTMAS TREE SUPPORTING TABLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of Christmas tree stands, more specifically, a table that acts as a stand to support a Christmas tree and of which elevates the Christmas tree.

B. Discussion of the Prior Art

As a preliminary note, it should be stated that there is an ample amount of prior art that deals with Christmas tree stands. As will be discussed immediately below, no prior art discloses a Christmas tree stand supporting table that includes a power strip inside of the table for powering the Christmas tree lights.

The Baumgartner patent (U.S. Pat. No. 5,732,926) discloses a stand having a readily adjustable trunk holder that can be adjusted to move the tree to the desired vertical the tabletop has an opening from which the base of the tree extends there through.

The Solak Patent Application Publication (U.S. Pub. No. 2006/0169865) discloses a stand for supporting a Christmas tree that has a train track along the perimeter of the base for supporting the Christmas tree. However, the tree stand does not resemble a table having an opening in the top for the base to pass through.

The Chapin patent (U.S. Pat. No. 5,131,618) discloses a way to display a working model railroad train set traveling around a Christmas tree. However, the display does not resemble a table with a box support that hides the base of the Christmas tree and the Christmas tree stand.

The Sofy et al. patent (U.S. Pat. No. 5,911,633) discloses a rigid decorative shell for surrounding a display stand that holds an upstanding element such as a Christmas tree or a display pole. However, the Christmas tree stand does not resemble a table with a box support that encloses both a Christmas tree base or the Christmas tree stand.

The Rakes patent (U.S. Pat. No. 2,874,496) discloses a display stand which has a train the encircles around the tree. Again, there is no table that supports the Christmas tree or stand.

The Eason patent (U.S. Pat. No. 1,943,659) discloses an elevated Christmas tree supporting stand. However, the supporting stand does not resemble a table having a tabletop with a hole about the middle from which a Christmas tree passes.

The De Carlo patent (U.S. Pat. No. 6,155,529) discloses a raised supporting stand that is used with a Christmas tree. Again, the supporting stand does not resemble a table having a circular table top with a hole about the middle for the Christmas tree to pass through, and of which includes a box support for containing the Christmas tree stand and a power strip for providing electrical access to the Christmas tree lights.

While the above-described devices fulfill their respective and particular objects and requirements, they do not describe a Christmas tree supporting table that provides for the advantages of the Christmas tree supporting table. In this regard, the Christmas tree supporting table departs from the conventional concepts and designs of the prior art.

SUMMARY OF THE INVENTION

The Christmas tree supporting table includes a box support, a circular tabletop that has a hole about the middle and is divided into two sections that are hingedly connected. The box support contains the Christmas tree stand and a power strip for powering the Christmas tree lights. The circular tabletop folds flat upon the box and the Christmas tree stand and base of the Christmas tree. The supporting table elevates the Christmas tree, hides the Christmas tree stand, and provides a hiding place for a power strip to supply electricity to the Christmas tree lights.

It is an object of the invention to provide a Christmas tree supporting table that conceals the base of the Christmas tree and the Christmas tree stand.

A further object of the invention is to provide a supporting table that elevates the Christmas tree.

A further object of the invention is to provide a supporting table that conceals a power strip.

A further object of the invention is to provide a supporting table that is easy to use, affordable, and effective.

These together with additional objects, features and advantages of the Christmas tree supporting table will be readily apparent to those of ordinary skill in the art upon reading the following detailed description of presently preferred, but nonetheless illustrative, embodiments of the Christmas tree supporting table when taken in conjunction with the accompanying drawings.

In this respect, before explaining the current embodiments of the Christmas tree supporting table in detail, it is to be understood that the Christmas tree supporting table is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of Christmas tree supporting table. It is therefore important that the claims be regarded as including such equivalent construction insofar as they do not depart from the spirit and scope of the Christmas tree supporting table. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
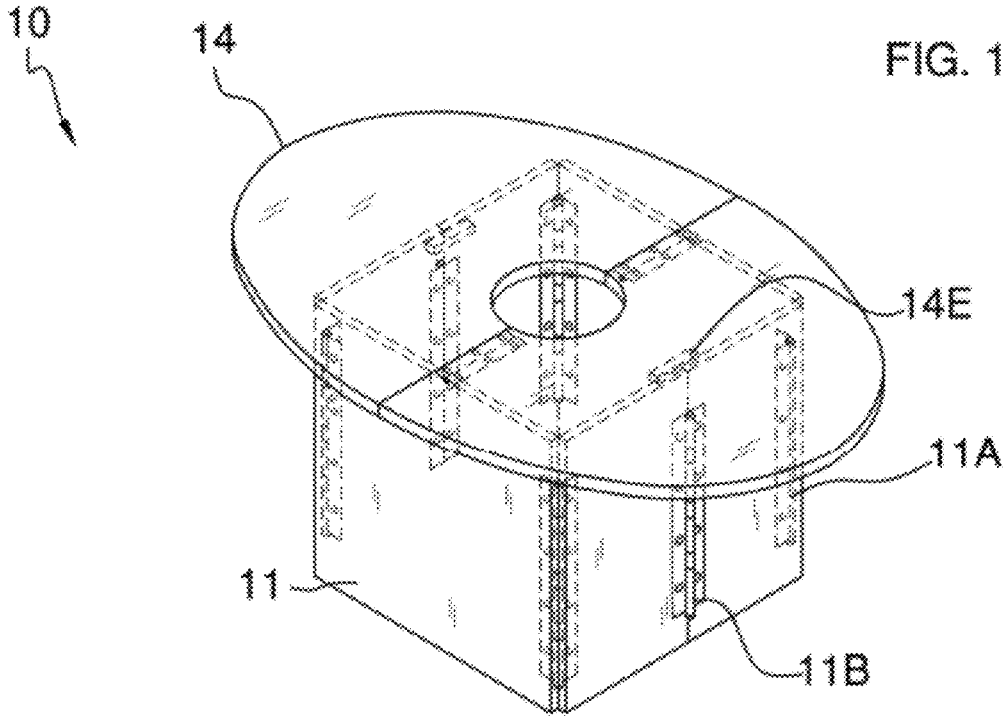
FIG. 1 illustrates an isometric view of the Christmas tree supporting table with the box support depicted in hidden lines in order to illustrate the plurality of hinges adorning said box support.

Detailed reference will now be made to the preferred embodiment of the present invention, examples of which are illustrated in FIGS. 1-7. A Christmas tree supporting table 10 (hereinafter invention) includes a box support 11, a plurality of support pieces 12, a tree support 13, and a tabletop 14. The support pieces 12, the tree support 13, and the tabletop 14 are made of a material comprising a durable plastic, a wood, or a metal.

The box support 11 has the top and bottom surfaces removed to enable access from either the top or the bottom of the box support 11. The box has corner hinges 11A located along each corner of said box support 11, and side hinges 11B along a first side and second side of said box support 11. The corner hinges 11A and side hinges 11B enable the box support 11 to fold flat when not in use (see FIG. 7).

The plurality of support pieces 12 are mounted to an interior surface of said box support 11 at equal elevations. The box support 11 has a plurality of holes 12A that correspond with the support pieces 12 in order to enable said box support 11 to fold flat (see FIGS. 2, 4, and 7). The tree support 13 rests upon the support pieces 12. However, it shall be noted that the tree support 13 may be fastened to the support pieces 12 by a fastening means comprising screwing, nailing, gluing, welding, bolting, or riveting. The tree support 13 elevates a Christmas tree 30, and upon the tree support 13 may rest either the base of the Christmas tree 30 or a Christmas tree stand (not depicted).

It shall be noted that the shape of the box 11 and the tree support 13 may include other geometrical shapes including a pentagon, hexagon, octagon, and so forth.

Figure 3:
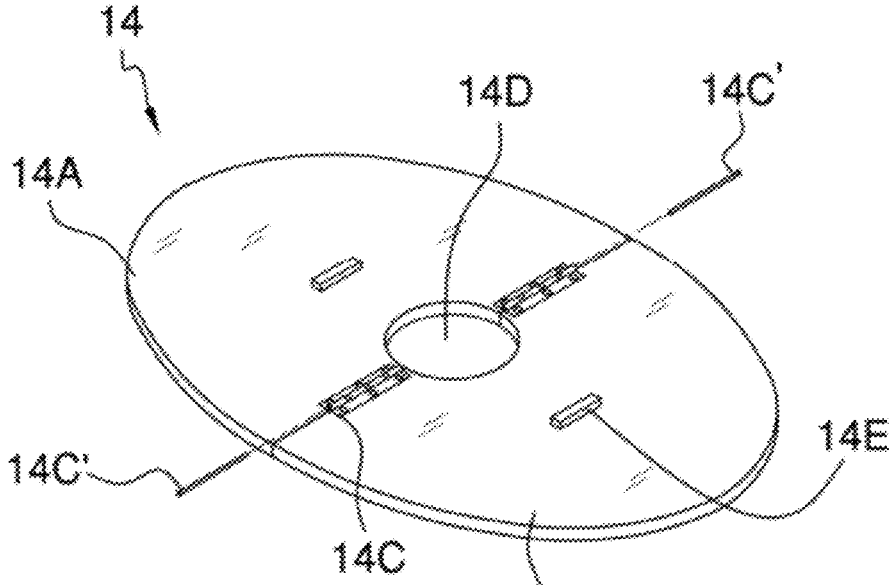
FIG. 3 illustrates a bottom isometric view of the tabletop, hinges, cleats, and further depicting the removable pins.
Figure 2:
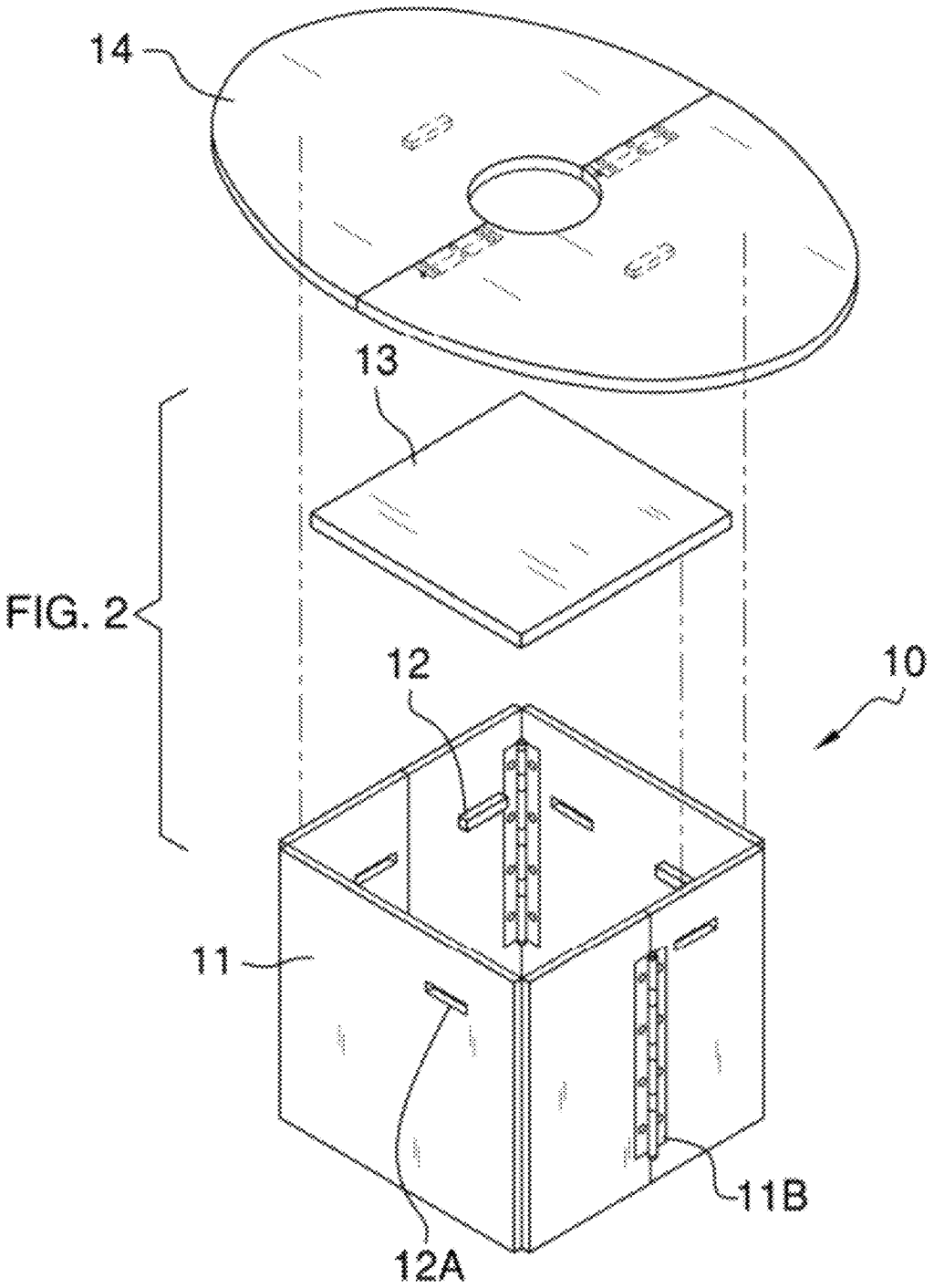
FIG. 2 illustrates an exploded view of the box support, the tree support, and the tabletop.
Figure 4:
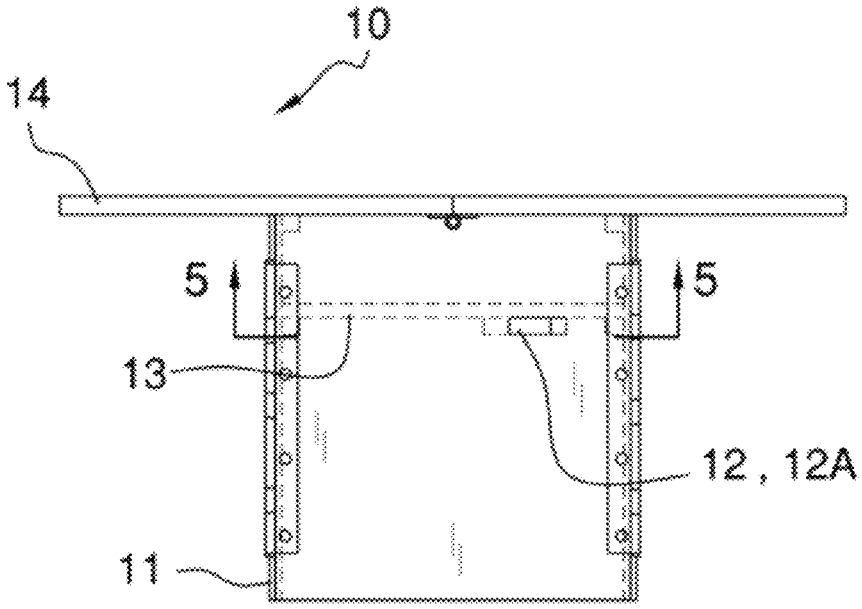
FIG. 4 illustrates a front view of the invention with hidden lines indicating the tree support as well as the hinges.
Figure 5:
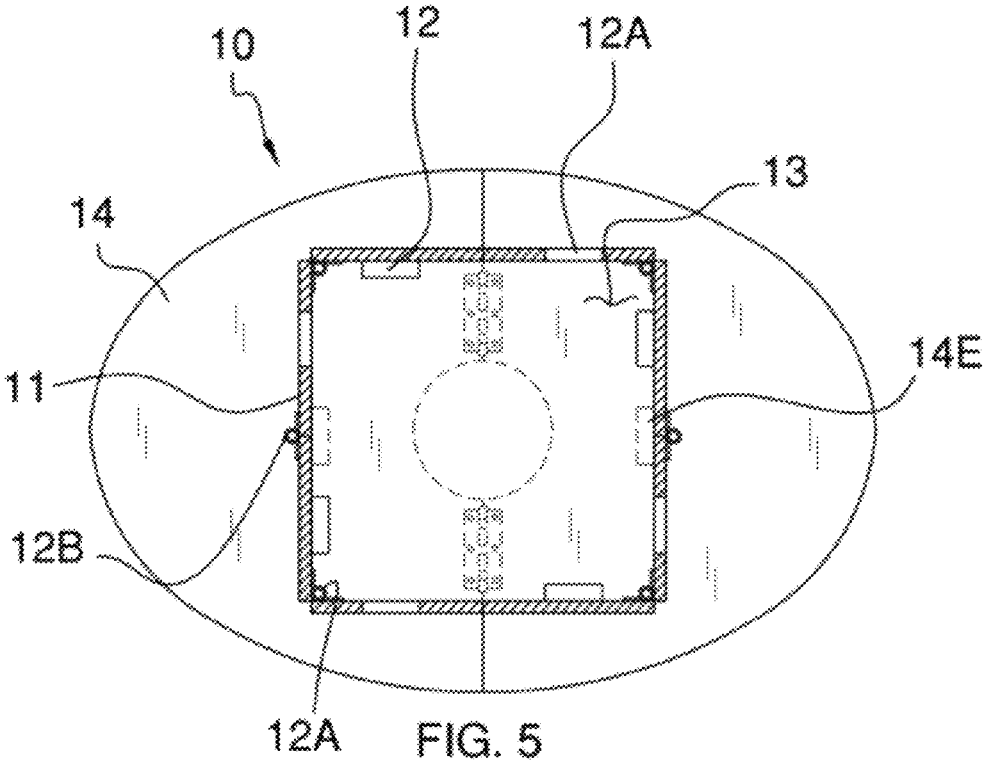
FIG. 5 illustrates a bottom view of the invention.
Figure 6:
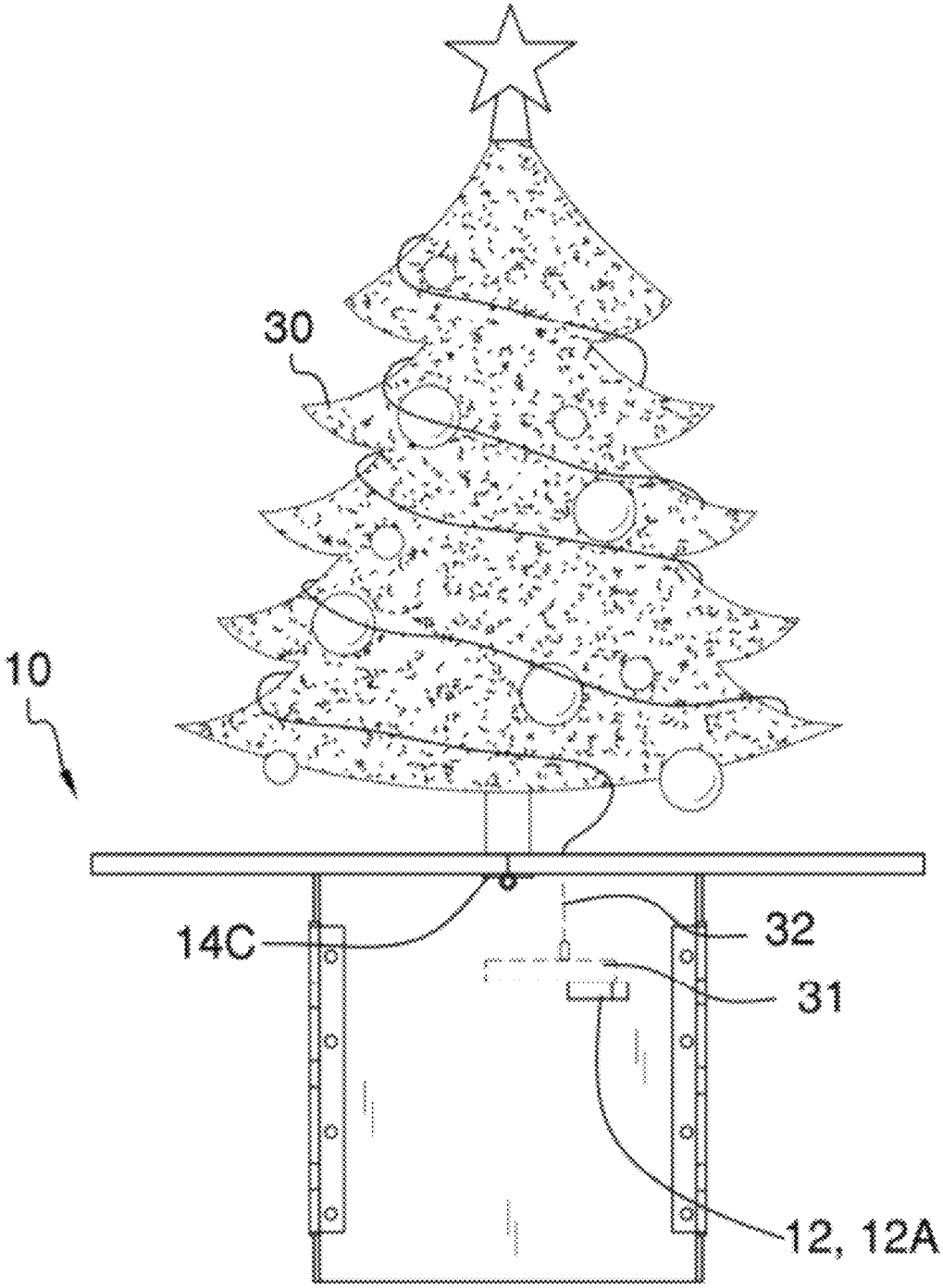
FIG. 6 illustrates a front view of the invention in use with a Christmas tree and hidden lines indicating a power strip.
Figure 7:
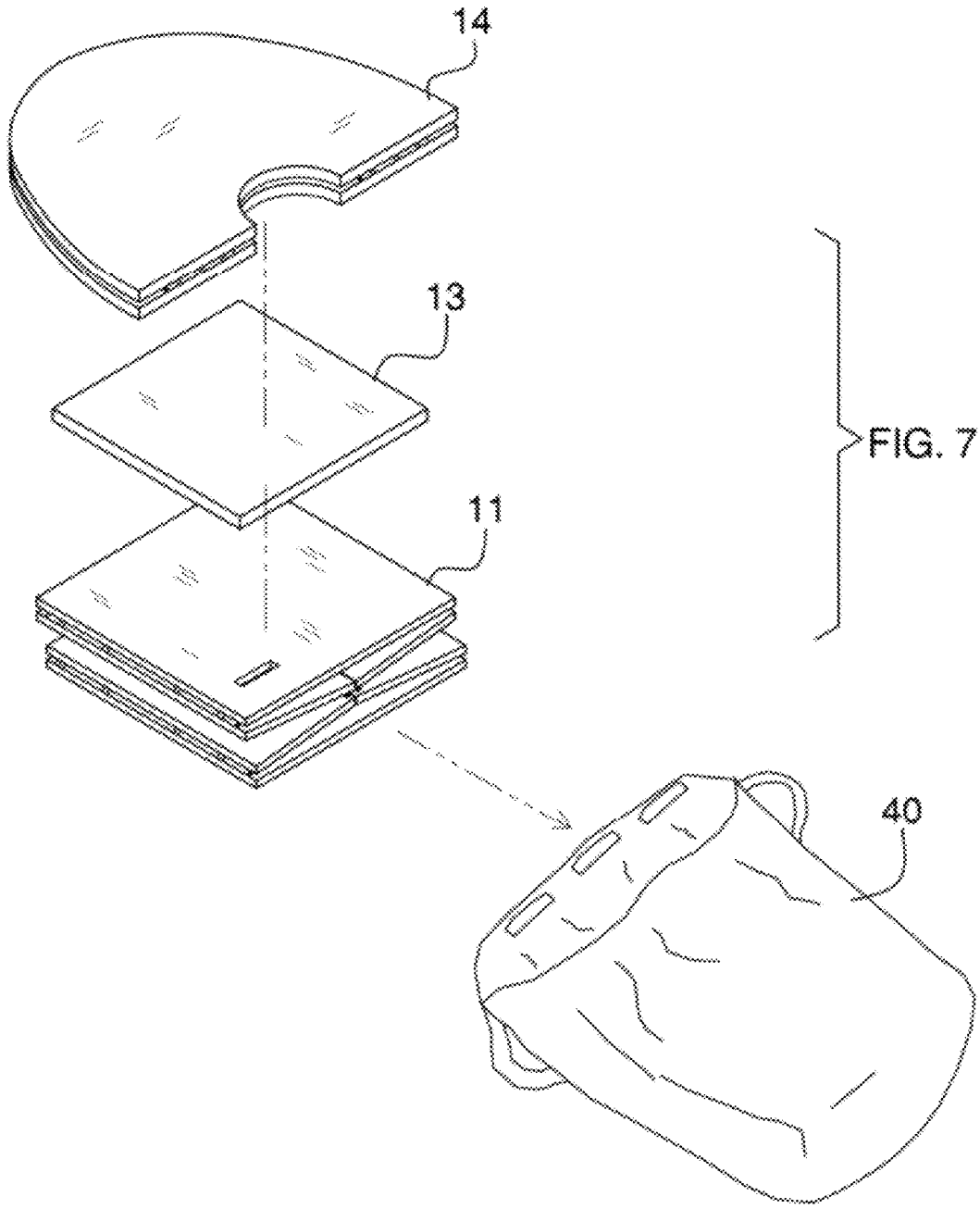
FIG. 7 illustrates the box support folded flat, the tree support, the tabletop folded flat, and a carrying bag.

The tabletop 14, as depicted, includes a first half 14A and a second half 14B that are connected via a plurality of hinges 14C. Referring to FIG. 3, the hinges 14C have removable pins 14C' that can be removed from said hinges 14C in order to disassemble the tabletop 14. It shall be noted that the hinges 14C may come without pins in order to provide a version that does not disassemble but rather folds flat. The center of the tabletop 14 has a hole 14D from which the Christmas tree 30 can pass through. The tabletop 14 also includes a plurality of cleats 14E that stabilize the tabletop 14 with respect to the box support 11.

However, it shall be noted that the tabletop 14 may simply be a flat object with a hole about the center, and no hingedly connected halves be required. In the alternative, the tabletop 14 may be comprised of at least three parts that are connected by a plurality of hinges.

Located on the top surface of the tree support 13 is a power strip 31, which can power a plurality of Christmas tree lights 32. The power strip cord can exit a hole (not depicted) on the side of the box 11.

The invention 10 shall include a bag 40 having Velcro tabs and a handle. The bag 40 provides a means of packing up the invention 10 when no longer in use.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventors claim:

1. A Christmas tree supporting stand for elevating a Christmas tree comprising:

a box support of which a top and a bottom of said box support is open such that the box support is comprised of four equal sides, and wherein a plurality of support pieces are mounted at an even height on the interior surface of said sides of said box support, wherein said box support has a plurality of holes that correspond with the support pieces in order to enable the box support to fold flat;

a tree support, which rests upon said support pieces, and of which elevates said Christmas tree;

a tabletop having a hole; wherein said tabletop rests upon said box support; and wherein said Christmas tree passes through said hole;

wherein said box support has hinges along each corner in order to enable the box to fold flat.

2. The Christmas tree supporting stand as described in claim 1 wherein said box support has two opposing sides divided into two vertically oriented halves that are connected via a side hinge, which enables the opposing sides to fold inwards, while the corner hinges enable said corners to extend.

3. The Christmas tree supporting stand as described in claim 1 wherein the tabletop is further comprised of two halves that are attached via a plurality of hinges and of which said hole is centrally located such that said tabletop can fold flat.

4. The Christmas tree supporting stand as described in claim 3 wherein said hinges have a removable pin that enables the hinges to be separated in order to disassemble said halves of said tabletop.

5. The Christmas tree supporting stand as described in claim 1 wherein said tabletop has a plurality of cleats along a bottom side of said tabletop in order to secure said tabletop to said box support.

6. The Christmas tree supporting stand as described in claim 1 wherein the tabletop, tree support, support pieces, and box support are made of a material comprising a durable plastic, wood, or metal.

7. The Christmas tree supporting stand as described in claim 1 wherein the tree support and tabletop conceals a power strip for powering Christmas tree lights and a Christmas tree stand.

8. The Christmas tree supporting stand as described in claim 1 wherein a bag is included to insert said tabletop, tree support, and box support when not in use.

9. A Christmas tree supporting stand for elevating a Christmas tree comprising:

a box support of which a top and a bottom of said box support is open such that the box support is comprised of four equal sides, and wherein a plurality of support pieces are mounted at an even height on the interior surface of said sides of said box support, wherein said box support has a plurality of holes that correspond with the support pieces in order to enable the box support to fold flat;

a tree support, which rests upon said support pieces, and of which elevates said Christmas tree;

a tabletop having a hole; wherein said tabletop rests upon said box support; and wherein said Christmas tree passes through said hole;

wherein said box support has hinges along each corner in order to enable the box to fold flat;

wherein said box support has two opposing sides divided into two vertically oriented halves that are connected via a side hinge, which enables the opposing sides to fold inwards, while the corner hinges enable said corners to extend.

10. The Christmas tree supporting stand as described in claim 9 wherein the tabletop is further comprised of two halves that are attached via a plurality of hinges and of which said hole is centrally located such that said tabletop can fold flat.

11. The Christmas tree supporting stand as described in claim 10 wherein said hinges have a removable pin that enables the hinges to be separated in order to disassemble said halves of said tabletop.

12. The Christmas tree supporting stand as described in claim 9 wherein said tabletop has a plurality of cleats along a bottom side of said tabletop in order to secure said tabletop to said box support.

13. The Christmas tree supporting stand as described in claim 9 wherein the tabletop, tree support, support pieces, and box support are made of a material comprising a durable plastic, wood, or metal.

14. The Christmas tree supporting stand as described in claim 9 wherein the tree support and tabletop conceals a power strip for powering Christmas tree lights and a Christmas tree stand.

15. The Christmas tree supporting stand as described in claim 9 wherein a bag is included to insert said tabletop, tree support, and box support when not in use.

* * * * *